United States Patent [19]

Ho

[11] Patent Number: 4,811,974

[45] Date of Patent: Mar. 14, 1989

[54] METHOD OF INDEXING A DICTIONARY AND THE INDEX SYSTEM THEREOF

[76] Inventor: Wan-Lan Ho, 1st Fl., No. 4, Lane 112, Sec. 2, Hsiu Ming Rd., Mucha, Taipei, Taiwan

[21] Appl. No.: 105,521

[22] Filed: Oct. 5, 1987

Related U.S. Application Data

[63] Continuation of Ser. No. 714,029, Mar. 20, 1985, abandoned.

[51] Int. Cl.[4] ..... B42D 15/00; B42F 21/00; B42F 21/04

[52] U.S. Cl. ..... 283/67; 283/36; 283/37

[58] Field of Search ..... 283/3, 4, 67, 36, 37, 283/38, 39, 40, 41, 42; 40/371, 378, 384; 101/32, 426

[56] References Cited

U.S. PATENT DOCUMENTS

| | | | |
|---|---|---|---|
| 472,630 | 4/1892 | Stephenson | 283/36 |
| 535,351 | 3/1895 | Brashear | 283/37 |
| 539,407 | 5/1895 | Bausman | 283/37 |
| 587,084 | 7/1897 | Wilson | 283/37 |
| 816,138 | 3/1906 | Threlkeld | 283/36 |
| 1,113,240 | 10/1914 | Nier et al. | 283/36 |
| 1,353,615 | 9/1920 | Savitsky | 283/36 |
| 3,504,907 | 4/1970 | Barber et al. | 283/37 |
| 3,718,349 | 2/1973 | Small | 283/67 |
| 3,995,398 | 12/1976 | Marulic et al. | 49/218 |
| 4,585,253 | 4/1986 | Beisswanger | 283/37 |

FOREIGN PATENT DOCUMENTS

| | | | |
|---|---|---|---|
| 130728 | 7/1919 | United Kingdom | 283/37 |

*Primary Examiner*—Donald R. Schran
*Assistant Examiner*—Paul M. Heyrana, Sr.
*Attorney, Agent, or Firm*—Spencer & Frank

[57] ABSTRACT

A method of indexing a dictionary and an indexing system thereof comprising the steps of: dividing the fore edge of a dictionary into an upper indexing area and a lower indexing area; diagonally labelling the twenty six English letters in alphabetical order on the upper indexing area of the fore edge according to the pages covered by the same first letter of the entries on a coordinate basis; marking the five English vowels A, E, I, O and U in the lower indexing area on the fore edge of the pages covering each vowel letter being arranged diagonally for corresponding to the relevant locations of the alphabets in the upper indexing area; and providing a plurality of labelling symbols to be respectively marked on both the upper and the lower indexing areas for separately representing the second and the third letters of an entry; so that, by referring to the letters and symbols on the divided fore edge of the dictionary, any entry that is sought can be quickly and accurately located therewith.

8 Claims, 7 Drawing Sheets

METHOD OF INDEXING A DICTIONARY AND THE INDEX SYSTEM THEREOF

This application is a continuation of application Ser. No. 714,029, filed Mar. 20th, 1985, abandoned.

BACKGROUND OF THE INVENTION

This invention relates to a method of indexing a dictionary with coordinate markings and special symbols for quickly locating an entry without turning page by page.

Conventionally, an index system or a reference number system is provided on the fore edge of a dictionary for aiding a user in finding the entries that are sought. As all the entries in a dictionary are usually arranged in alphabetical order, the known index systems generally include the marking of the English alphabet on the pages covered by the same first letter of the entries, the arrangement of thumb indexes on the fore edge of the dictionary, and the provision of specified colors and stripes along with the alphabet marks. For many years these index systems have been widely used by people but little improvement has been made for quickly locating the desired entry at the exact page. Therefore, the user can find the entry within a specified region but must turn each page in that section to locate the exact one that is sought. The Swiss Pat. No. 253020 issued to Paul Senn on November 1, 1948 taught a color coding system in combination with the English alphabet labelled on the fore edge of the dictionary; and the French Pat. No. 2,291,039 issued to kimel also disclosed an indexing system with different marking stripes assigned to the individual letters, yet all these indexing systems share the same problem as described above.

SUMMARY OF THIS INVENTION

It is accordingly a primary object of this invention to provide an improved method of indexing a dictionary and an index system thereof that overcomes the problem associated with the prior art.

According to the present invention, this and other objects are achieved by providing a method of indexing a dictionary, which method comprises the steps of: dividing the fore edge of the dictionary into a plurality of areas including an upper indexing area and a lower indexing area; diagonally labelling the English letters in alphabetical order on the fore edge of the upper indexing area by grouping the pages covered by each letter of the alphabet which are respectively marked on a coordinate basis; diagonally marking the English vowels A. E. I. O. and U on the lower indexing area of the fore edge at the locations corresponding to the relevant positions marked in the upper indexing area; and providing a plurality of symbols on both the upper and the lower indexing areas for separately representing the second and the third letters of an entry in conjunction with the letters of the English alphabet furnished thereto; so that, by referring to the marked letters and symbols thereof, any entry that is sought by the user can be quickly located through the first three letters of the entry without turning each page of that section.

Further characteristics and advantages of this invention will become clear from the following description of a preferred embodiment when read in conjunction with the accompanying drawings.

DETAILED DESCRIPTION OF THE PREFERRED EMBODIMENT

Figure 1:
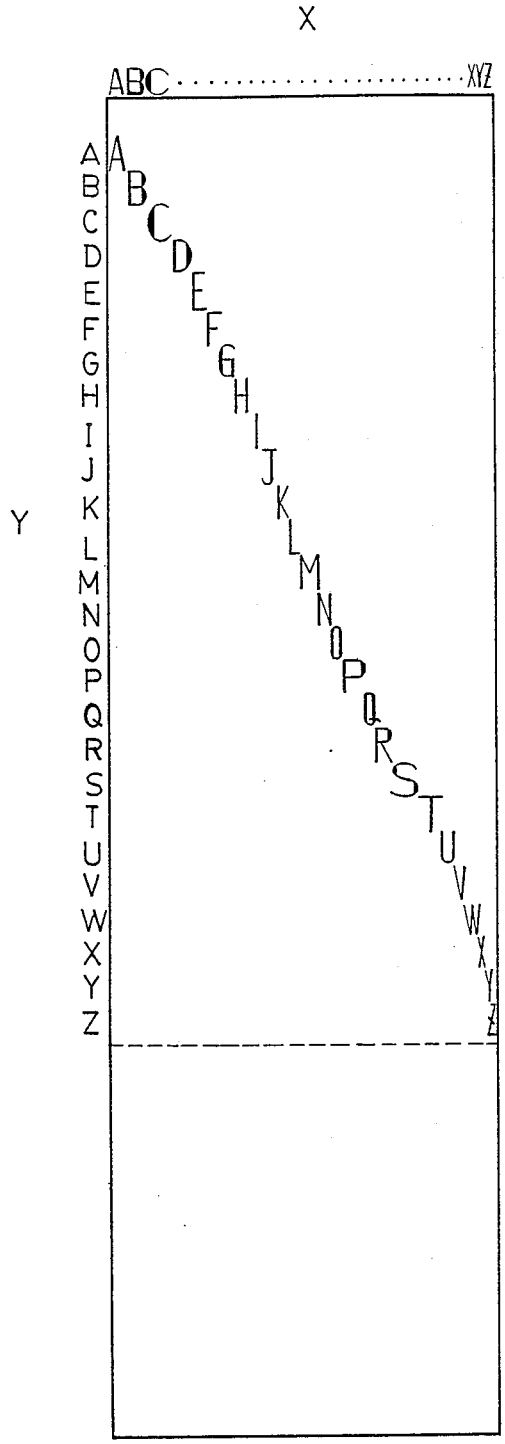
FIG. 1 is a reference view indicating the fore edge of a dictionary incorporated with the English alphabet labelled on a coordinate basis according to a prior art.

Referring to FIG. 1 there shows a reference drawing for explaining the basic coordinate conception adopted by this invention. As it is well known, the plane coordinate system is composed of an X-axis as the abscisa and an Y-axis as the ordinate. By referring to the coordinates of the two axes (X,Y), any specific point in the plane can be located and vice versa. This coordinate principle is applicable to the method of this invention. As shown in FIG. 1, the 26 English letters are respectively arranged in alphabetical order along the X and Y axes for being figuratively used as the coordinates.

Taking the Random House College Dictionary (Revised Edition) as an example, the 26 letters of the English alphabet are respectively marked on an X-axis in correspondence with the covered region of each letter from A to Z while the marking of each letter from A to Z on the Y-axis is separately spaced in 0.7 centimeters. As a result, the fore edge of the dictionary is incorporated with a coordinate plane. Additionally, the coordinate region A,A on the fore edge of the dictionary is marked as A, the coordinate region B,B marked as B, and so forth until the last coordinate region Z,Z is marked. Consequently, the 26 letters of the English alphabet are diagonally labelled on the fore edge of the dictionary. This is the basic idea applied by this invention.

Figure 2:
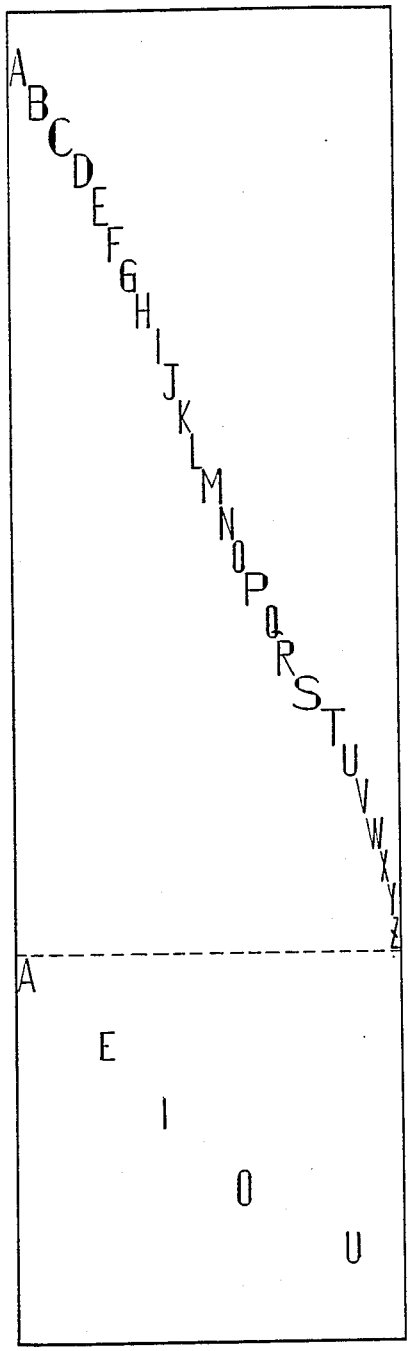
FIG. 2 is a perspective view of the fore edge of a dictionary embodying an index system of this invention.

Referring to FIG. 2, there shows a preferred embodiment of a method of indexing a dictionary and an indexing system thereof in correspondence with this invention. The method of this invention comprises the steps of: dividing the fore edge of the dictionary into a plurality of indexing areas—an upper indexing area 1 and a lower indexing area 2 where the spaces of these two areas 1 and 2 are separately determined for coordinated marking operations as mentioned above; grouping pages that include the entries that have the same first letters; making letters from A to Z on the fore edge of each of the grouped pages covered by the same first letters in the upper indexing area 1 in diagonal form; marking each of the grouped pages with vowel letters a, e, i, o and u in the lower indexing area 2 in diagonal form longitudinally corresponding to the position sequence in the upper indexing area 1; designating six kinds of symbols distinguishable in either colors or geometrical marks including (1) ⁞ an upper short bar and a lower long bar, (2) ⁞ three short bars, (3) ı one short bar, (4) ⁞ an upper long bar and a lower short bar, (5) ⁞ two short bars, and (6) | a long bar for representing the second letters of each entry in the individually covered regions of the English alphabet, wherein the first five symbols ¦, ¦, ı, ¦, and ¦ represent the five vowels A, E, I, O and U and are marked in the upper indexing area 1 while the sixth symbol | denotes in the upper area 1 each entry whose second letter is a consonant and also denotes in the lower indexing area 2 each entry whose second letter is a vowel; labelling in the upper indexing area 1 the five symbols respectively representing each vowel as the second letter of each entry on the fore edge of the grouped pages thereof at separate locations in coordinate correspondence to the letters marked on the fore edge which are identical to the first and third letters of the last entry(ies) of the left or right side of the leaf (leaves) labelled; and labelling the sixth symbol | in the upper indexing area 1 on the fore edges of the pages that cover entries whose second letters are of the same consonants and in the lower indexing area 2 on the fore edges of the pages that cover entries whose second letters are of the same vowels.

Figure 3:
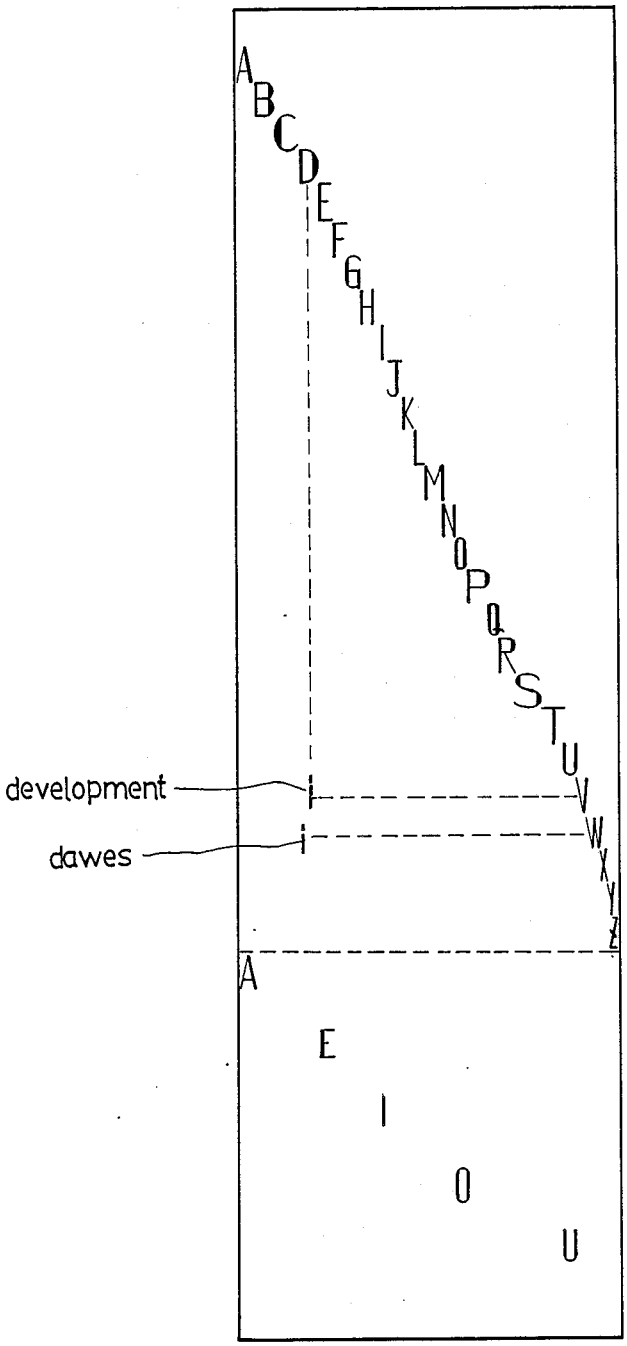
FIGS. 3A and 3B are illustrative views showing how to locate an entry by referring to the front three letters of the entry.
Figure 3A:
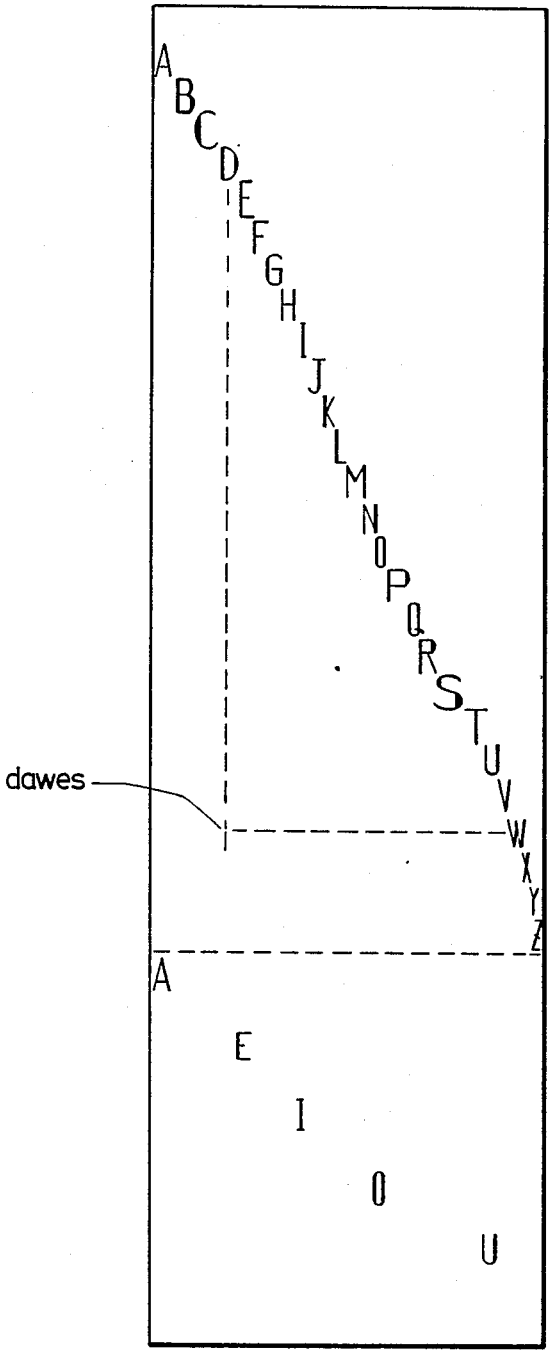
Figure 4:
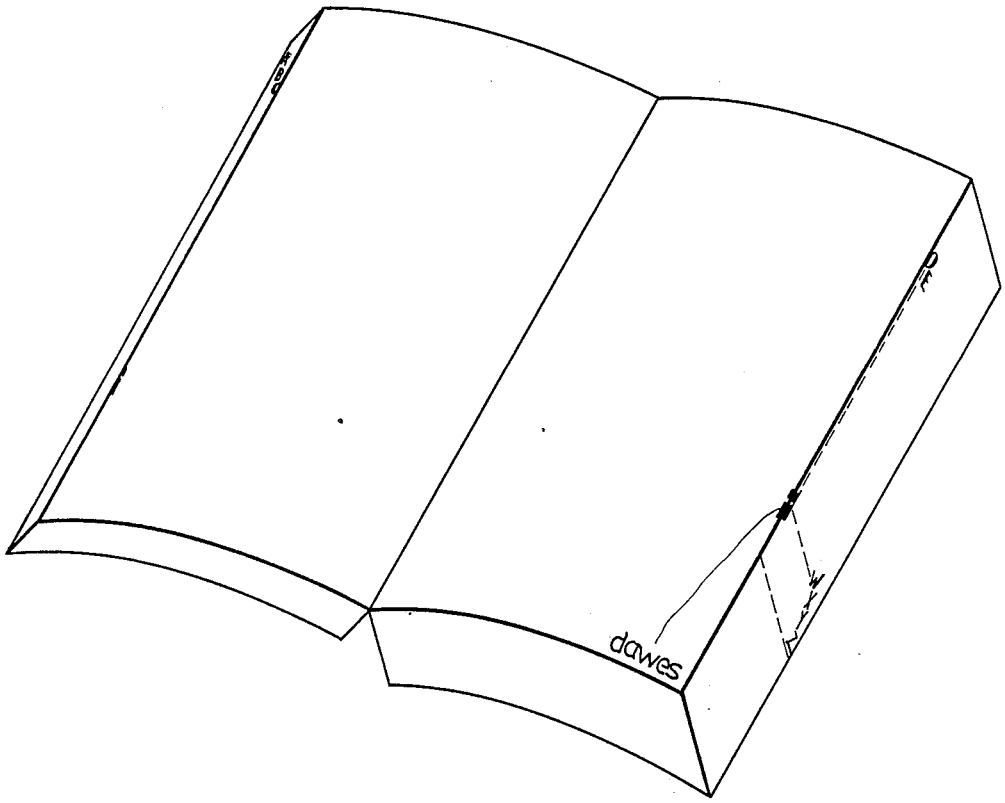
FIG. 4 is a perspective view of the dictionary turned to an entry "dawes" that is sought by using this invention.

Referring to FIGS. 3A and 4, there shows a practical application of the symbols described above. The fore edges of the pages covering entries having vowel "a" as the second letter, such as ba-(on pages 97–116), ca-(on pages 187–215), da-(on pages 334–339), fa-(on pages 472–482) . . . etc., are labelled with the first symbol ¦ at the coordinate areas where the letter on the X-axis identical to the first letter of the last entry of the left (or right) side of the leaves labelled and the letter on the Y-axis identical to the 3rd letter of the same entry. Taking "Dawes" as an example, since the third letter of the word is "w", the symbol ¦ representing the vowel letter "a" as the second letter of the word "Dawes" is labelled on the fore edge of page 339 at a location where the first letter "D" of the word "Dawes" on the X-axis and the third letter "W" on the Y-axis intersect. Thus, when the marked dictionary is closed, the symbol is present at the location horizontally corresponding to the letter "W" marked in the upper indexing area 1.

Figure 3B:
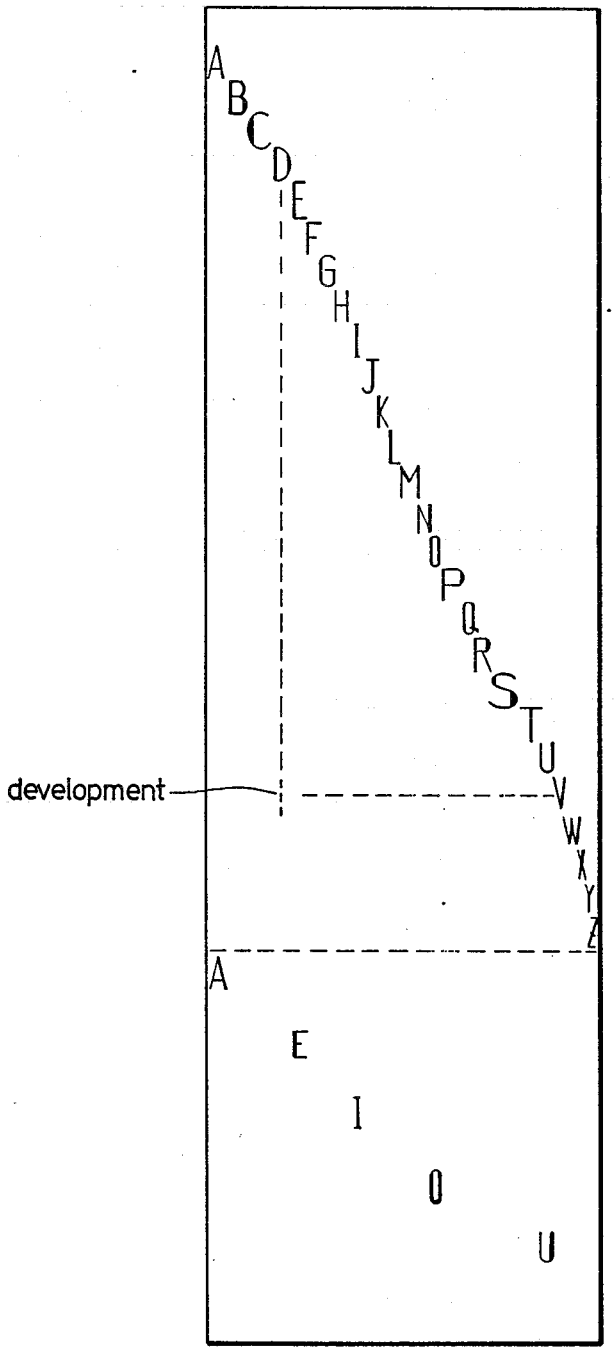

Referring to FIG. 3B, the symbol ¦ indicating "e" as the second letter of the word "development" on page 363 is marked on the fore edge of the relevant pages of "de-" at the location intersected by the coordinates of "D" on X-axis and "V" on Y-axis. Similarly, the remaining symbols ı, ¦, and ¦ for the vowels i, o and u as the second letters of the related entries are respectively labelled on the separate coordinate areas in the upper indexing area 1. Consequently, the upper indexing area 1 of the dictionary is provided with the five symbols ¦, ¦, ı, ¦, and ¦ indicating the locations of the vowel letters a, e, i, o, and u as the second letters to all the relevant entries.

The indexing method described and illustrated hereinbefore is related to labelling all the entries in the English dictionary whose second letter is a vowel, because about 80% of the entire entries in an English dictionary are those whose second letters are one of the vowels. In addition, when the indexing system of this invention is applied in the upper indexing area 1 of any dictionary, 90% of the pages covered therein are separately marked with the symbols described for enabling the users to quickly locate the entries that are sought without turning page by page.

It shall be appreciated that the six symbols described and illustrated hereinbefore can be assigned with specific colors in representing the five vowels A, E, I, O and U as well as all the consonants.

Figure 5:
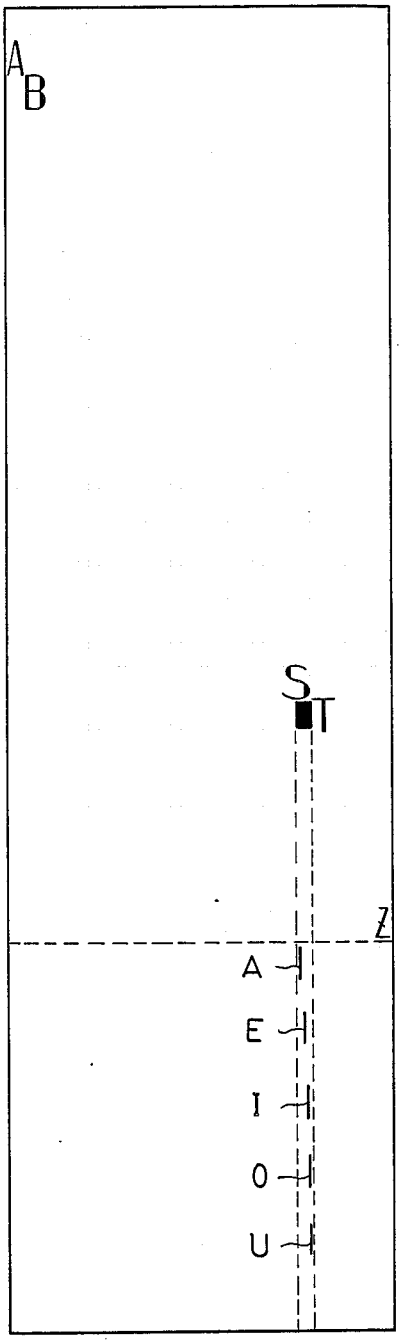
FIG. 5 is an illustrative view indicating a portion of the fore edge of the dictionary with a detailed marking for the third letter of an entry according to this invention.

To embody the present invention in a more specific yet slightly different manner, the sixth symbol | is labelled on the fore edge of both the upper and the lower indexing areas 1 and 2. In the lower indexing area 2, the pages covered by the five vowels A, E, I, O and U as shown in FIG. 2 are separately marked with the sixth symbol |, indicating that the second letter of each entry beginning with a vowel is also a vowel letter such as "au-", "ea-", "ou-", etc. whereas the sixth symbol | labelled in the upper indexing area 1 on the fore edge of the pages having the same second letter of each entry indicates the beginnings of entries such as "bl-", "cr-", "dr-", "fl-", "gr-", "hy-", "kn-", "pl-", "sc-", "th-", "sh-", etc. With this method of indexing on the fore edge of the dictionary marked with the designated six symbols ¦, ¦, ı, ¦, ¦ and |, those entries beginning with either a vowel or a consonant which is followed by either a consonant or a vowel as their second letters can be easily and quickly located in the upper indexing area 1; while, those entries beginning with a vowel which is followed by a vowel as their second letter can be rapidly and exactly located in the lower indexing area 2. However, for those entries whose second letters are a consonant that covers relatively more pages, a detailed marking arrangement is made as follows:

Referring to FIG. 5, the sixty symbol | is applied to label the third letters of those entries whose second letter is a consonant but the third letters are either a vowel or a consonant. It is preferable that a certain distinctive color be used for this sixth symbol in labelling the third letters of those, entries so as to clearly distinguish itself from all six symbols labelled therein. Take "st-" as an example, the pages covered by the "st-" are greater in quantity, and the covered region thereof is marked with a number of the sixth symbol | as shown in FIG. 4 respectively representing such beginnings of entries either as "sta-", "ste-", "sti-", "sto-", and "stu-" whose third letters are vowels or as "str-" whose third letter is a consonant, corresponding longitudinally to the region covered by the "st-" symbol and horizontally to the five vowels of the 2nd indexing area and the consonant "R" of the 1st indexing area originally labelled in the fore edge of the dictionary. Therefore, when one looks for the entry of "stock", for instance, as one simply refers to the "st-" region in the upper indexing area 1, and then turns the fore edge of the dictionary provided with the said symbol | indicating "o" as the 3rd letter in either the upper or the lower indexing area, the entry "stock" can be quickly and accurately located thereat. In a like manner, those pages having been divided into a number of regions, each region having entries with the same first letter and the same consonant as their second letters is sub-divided into a number of sub-regions, and each sub-region is labelled with the same symbol, such as the sixth symbol |, in the same color as that used for labelling the sub-regions respectively covered in the "st-" region. With this detailed labelling in the lower indexing area 2, it is very convenient for the user to promptly locate any entry in the dictionary provided with this indexing system of the present invention by simply referring to the initial three letters in succession of an entry. It shall be appreciated that the symbols representing the third letters labelled therein will not cause any confusion with those representing the second letters, and that all the symbols labelled on the fore edge of a dictionary would on no account overlap with each other because no two symbols labelled therein such as "st-" and "str-" or "st-" and "co-" are similar to each other with respect to the coordinate position. As to those entries whose second letters cover a small region of pages in the dictionary, no further labelling is required because, by sequentially referring to the initial two letters of those entries, they can be easily located without turning page by page.

While I have described and illustrated my invention by means of a specific embodiment, it is to be understood that numerous changes and modifications may be made therein without departing from the spirit and scope of the invention as defined in the appended claims.

What I claim is:

1. A method of indexing a dictionary and an indexing system thereof comprising the steps of:

dividing the fore edge of a dictionary into a plurality of indexing areas with a predetermined space for each area;

diagonally marking the twenty-six English letters in alphabetical order on the fore edge of an upper indexing area of said indexing areas according to the pages covering entries that have the same first letter similar to the one marked on their fore edges and at a location intersected by the coordinates thereof;

marking the five English vowels A, E, I, O and U on the fore edge of a lower indexing area of said indexing areas and at the locations longitudinally corresponding to the same vowel letters marked in said upper indexing area thereof;

designating a plurality of labelling means for respectively denoting the second letter of each entry covered by a region marked on the fore edge with the letter of the alphabet;

separately labelling said labelling means on the fore edge of said upper indexing area and at each region covering entries that have the same second letter in (vowel) both vowel and consonant, and on the fore edge of said lower indexing area at the region covering entries that have the same second letter in (consonant) vowel; and respectively labelling a same one of said labelling means in said indexing areas to separately represent the third letters of those entries whose first and second letters appear in more pages therein; so that, by referring to the marking of letters and said labelling means, any entry that is sought can be quickly and accurately located therewith.

2. A method of indexing a dictionary and an indexing system thereof according to claim 1 wherein said labelling means comprise six symbols, including ¦, ¦, ı, ¦, ¦, and |.

3. A method of indexing a dictionary and an indexing system thereof according to claim 2 wherein said labelling means comprise six different colors for making a distinction between each other.

4. A method of indexing a dictionary and an indexing system thereof according to claim 3 wherein said six symbols are designated as follows:

symbol 1 ¦ including an upper short bar and a lower long bar for denoting the English vowel "A";

symbol 2 ¦ including three short bars for denoting the English vowel "E";

symbol 3 ı including one short bar for denoting the English vowel "I";

symbol 4 ¦ including an upper long bar and a lower short lower bar for denoting the English letter "O" symbol 5 ¦ including two short bars for denoting the English letter "U"; and symbol 6 | including one long bar for denoting the second consonant letter of an entry in said upper indexing area but denoting the second vowel letter of an entry in said lower indexing area.

5. A method of indexing a dictionary and an indexing system thereof according to claim 4 wherein said symbols 1 through 5 are respectively labelled in said upper indexing area and located at a position horizontally corresponding to a letter marked on the fore edge similar to the third letter of a first or a last entry on either the left or right side of the labelled (page) leaf.

6. A method of indexing a dictionary and an indexing system thereof according to claim 4 wherein said symbol 6 | is labelled in said upper and lower indexing areas at all the regions covering the entries having the same second letter.

7. A method of indexing a dictionary and an indexing system thereof according to claim 6 wherein a same symbol of said labelling means is further labelled in said upper indexing area as well as in said lower indexing area at the regions divided from bigger regions having more pages that cover entries beginning with the same first and second letters to cover entries that have the same third letters in a sub-divided region.

8. A method of indexing a dictionary and an indexing system thereof according to claim 7 wherein the labelling of said same symbol in said upper and lower indexing areas further comprises a specific color designated thereto clearly distinguishable from said symbols 1 through 6 labelled in said upper and lower indexing areas.

* * * * *